US006041568A

United States Patent [19]

Alderman et al.

[11] Patent Number: 6,041,568

[45] **Date of Patent: *Mar. 28, 2000**

[54] APPARATUS FOR MOVING A CARRIAGE ALONG THE LENGTH OF PURLINS OF A ROOF STRUCTURE AND METHOD OF USING SAME

[75] Inventors: Robert J. Alderman, Canyon Lake; James E. Taylor, Seguin, both of Tex.; Ernest Craig Abney, Deltona; Ernest Abney, Winter Garden, both of Fla.

[73] Assignee: Owens Corning Fiberglas Technology, Inc., Summit, Ill.

[ * ] Notice: This patent is subject to a terminal disclaimer.

[21] Appl. No.: 09/052,254

[22] Filed: Mar. 31, 1998

[51] Int. Cl.[7] ..... E04G 21/14

[52] U.S. Cl. ..... 52/749.12; 52/746.11; 52/404.1; 52/478; 242/557; 242/598.5; 242/610.3

[58] Field of Search ..... 52/749.12, DIG. 1, 52/746.11; 294/82.11, 82.1; 242/557

[56] References Cited

U.S. PATENT DOCUMENTS 3,983,676 10/1976 Gilpin .
4,068,446 1/1978 Brueske .
4,967,535 11/1990 Alderman .
5,551,203 9/1996 Alderman et al. ..... 52/749.12
5,653,081 8/1997 Wendrick et al. ..... 52/749.12
5,653,083 8/1997 Alderman et al. ..... 52/746.11
5,664,740 9/1997 Alderman et al. ..... 52/749.12
5,685,123 11/1997 Alderman et al. ..... 52/749.12
5,911,385 6/1999 Neifer et al. ..... 52/749.12
5,921,057 7/1999 Alderman et al. ..... 52/749.12

*Primary Examiner*—Carl D. Friedman
*Assistant Examiner*—Dennis L. Dorsey
*Attorney, Agent, or Firm*—Inger H. Eckert; Stephen W. Barns

[57] ABSTRACT

An apparatus for moving a carriage along a roof structure of the type having a plurality of purlins spaced apart from one another in a parallel arrangement, and method of using same are disclosed. The apparatus includes a grappling member mounted for movement along the length of a first one of the plurality of purlins. The grappling member is adapted to be temporarily placed into a locked position so that the grappling member is fixed with respect to the first purlin. A tension member operatively connects the grappling member to the carriage. A pulling device is used to pull on the tension member so as to shorten the distance between the grappling member and the carriage, thereby advancing the carriage along the length of the purlins in a direction towards the grappling member when the grappling member is in the locked position.

27 Claims, 8 Drawing Sheets

APPARATUS FOR MOVING A CARRIAGE ALONG THE LENGTH OF PURLINS OF A ROOF STRUCTURE AND METHOD OF USING SAME

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material is supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

The carriage can be any length up to the width of the roof itself. For example, the carriage can be comprised of a plurality of carriage sections which are joined together so that they span the entire width of the roof. Each carriage section has a roll of support sheet dispensing the support sheet across two adjacent purlins. The carriage is then propelled across the purlins so that the carriage sections move in unison.

In the past, the carriage was pulled across the roof along the length of the purlins by means of a relatively long cable and large winch fastened to the carriage. The cable was typically 200 feet long and had a conventional hook attached at the end of the cable. The cable was reeled out from the spool of the winch and then hooked to a flange of a rafter beam. If the roof structure was longer than 200 feet, the cable was attached to the farthest rafter beam which the cable was able to reach. The winch was then manually operated to take up the cable about the spool of the winch so as to advance the carriage. It was preferred that the cable be as long as possible, so that the cable did not have to be re-attached to a different rafter beam often. Because the winch is attached to the carriage and moves over and across the rafter beams, the cable is laid across the tops of all the rafter beams between the carriage and the end of the roof structure. However, it can be difficult and time consuming to unroll the cable and pull the end of the cable across the rafter beams 200 feet away from the carriage. It is also difficult to initially attach the hook at the end of the roof structure since this requires a worker to climb to the top of the end of the roof structure. Since the cable is relatively long, the cable is relatively heavy and awkward to handle. Also, the size of the winch is relatively large and heavy to accommodate the length of the cable required to span across the roof structure.

It would be desirable to have an apparatus and method for moving the carriage along the length of the purlins which is relatively simple and fast to perform.

SUMMARY OF THE INVENTION

The above objects as well as other objects not specifically enumerated are achieved by an apparatus and a method of using the same for moving a carriage along a roof structure. The apparatus and method provides for a relatively simple and fast system for moving the carriage.

The apparatus of the present invention provides for a roof structure of the type having a plurality of purlins spaced apart from one another in a parallel arrangement. The apparatus includes a carriage which is mounted for movement along the length of the plurality of purlins. A grappling member is also mounted for movement along the length of one of the plurality of purlins. The grappling member can be temporarily placed into a locked position so that the grappling member is fixed with respect to the fixed portion of the roof structure, such as the purlins. A tension member operatively connects the grappling member to the carriage. The apparatus further includes a pulling device for pulling the tension.

To advance the carriage, the grappling member is first moved along the length of a purlin in a first direction away from the carriage. The grappling member is then fixed relative to the purlin by placing the grappling member in the locked position. The pulling device is operated so that the pulling device pulls on the tension member, thereby advancing the carriage along the length of the purlins in the first direction towards the grappling member. After the carriage has advanced the selected distance, the grappling member can be moved again along the length of the purlin, and the procedure is repeated, thereby systematically advancing the carriage along the roof structure.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
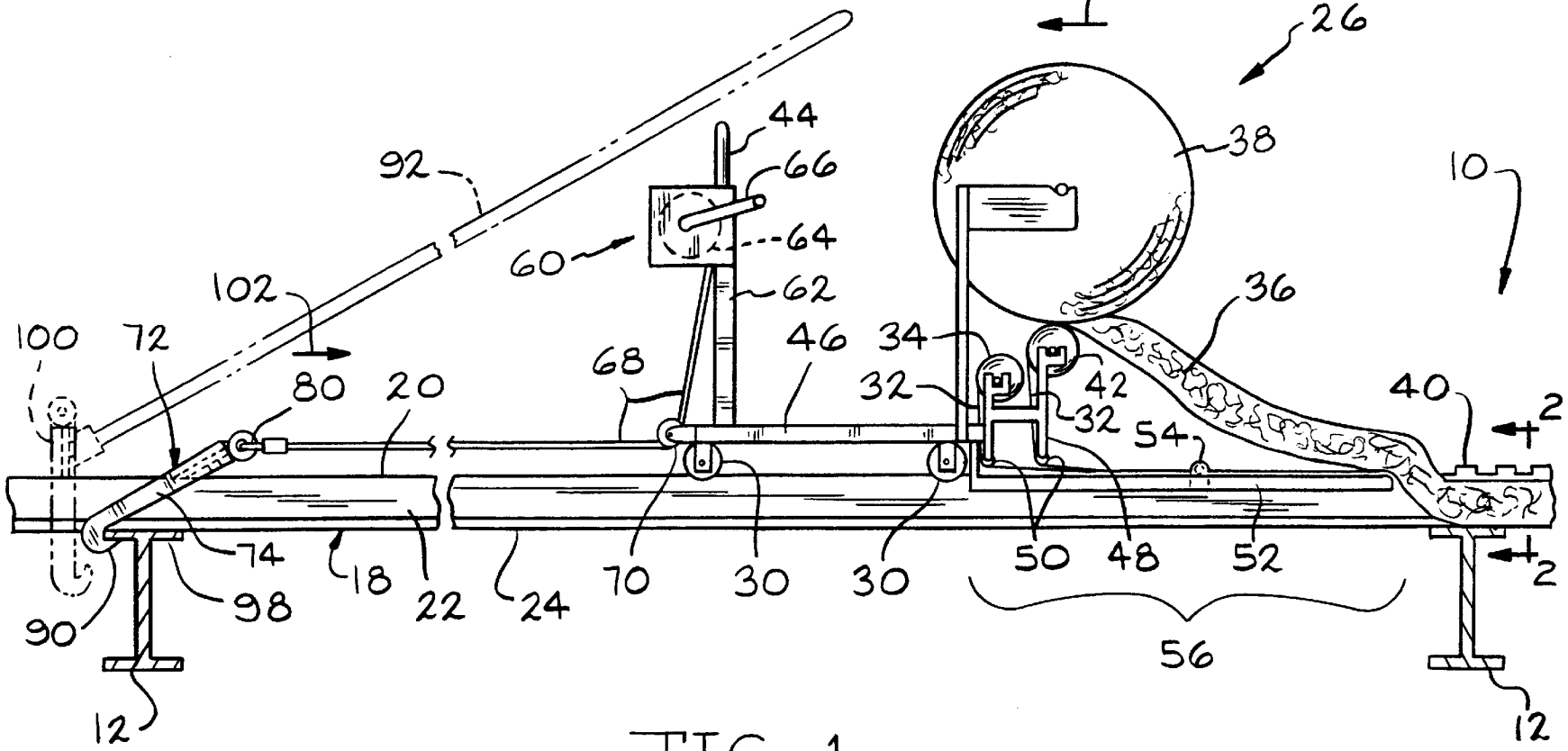
FIG. 1 is a schematic elevational side view of a carriage on top of a roof structure, wherein the carriage has members for advancing the carriage along the length of the purlins, in accordance with the present invention.
Figure 2:
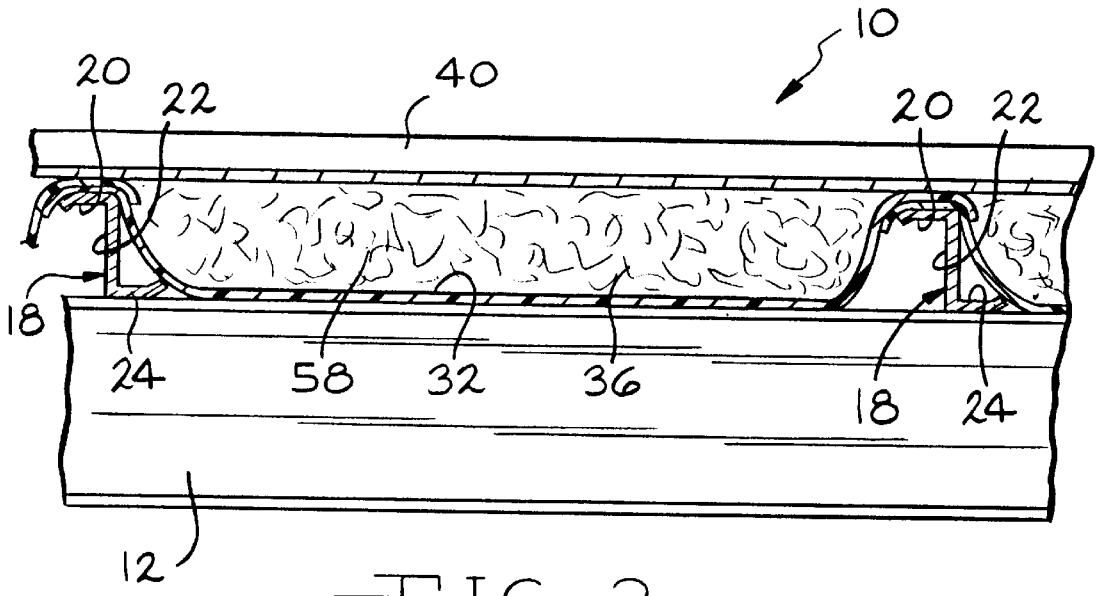
FIG. 2 is a schematic sectional view taken along Line 2—2 of FIG. 1 illustrating a completed section of the insulated roof structure.

Referring to FIGS. 1 and 2, there is illustrated a partially completed building roof structure, indicated generally at 10. The roof structure is supported by a building framework which includes main rafter beams 12 positioned parallel to each other. A plurality of purlins 18, spaced apart and arranged parallel to each other, is fastened on top of the rafters in a direction normal to the rafters. The building framework may have two sloped sections (not shown) which are joined together to form a peak. The sloped roof sides generally provide for rain and snow drainage. The spacing of the rafter beams is typically within the range of from about 25 to about 30 feet (7.6 to about 9.1 meters) on centers. The spacing of the purlins is typically about 5 feet (1.52 m) on centers. As best shown in FIG. 2, the purlins typically have a generally Z-shaped cross-section, and include a horizontally extending upper portion 20, a vertically extending web 22, and a horizontally extending lower portion 24. Of course, roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members.

Broadly stated, the roof structure is constructed by use of a carriage, indicated generally at 26, which rides on the upper portion 20 of the purlins and travels along the length of the purlins in a downstream direction, represented by an arrow 28, as shown in FIG. 1. Preferably, the carriage has rollers 30, rotatably mounted on the carriage, which roll along the upper portions of the purlins. As the carriage is moved, a support sheet 32 is payed out from a roll 34. The support sheet is draped on top of adjacent purlins so that the support sheet depends from the upper portion of the purlins, as shown in FIG. 2. The support sheet supports a layer of insulation material 36 which is placed on top of the support sheet between the adjacent purlins. The insulation material is typically dispensed from a roll 38 but can be applied by any suitable manner, such as by applying insulation batts on top of the support sheet. Alternatively, a layer of insulation may be placed laterally across the purlins. After the insulation material has been placed on the support sheet, long sheets of hard roofing material 40, such as metal roof decking, are then attached to the upper portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the upper portion 20 of the purlins and the hard roofing material 40, so that the support sheet supports the insulation between the purlins.

Because the hard roofing material comes in long sheets, typically 30 to 35 feet (9.1 to 10.7 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

The carriage can be any length up to the width of the roof itself. Preferably, the carriage is comprised of a plurality of carriage sections which can be joined together so that they span the entire width of the sloped section of the roof. The carriage is then propelled across the purlins, as will be discussed in detail below, in the downstream direction 28 so that all the carriage sections move in unison. Because the support sheet is draped across the upper portion of adjacent purlins, the total width of the support sheet is wider than the distance between the purlins. Therefore, adjacent support sheet rolls are not co-linear and must be slightly staggered. Typically, a carriage section covers two purlin spans, i.e., about 10 feet (3.3 m) in length. Therefore, each carriage section preferably has both a leading roll 34 and a trailing roll 42 of insulation support sheet, one roll for each of two adjacent purlin spans. The edge of the support sheet from the trailing roll 42 will be draped on top of the edge of the support sheet from the leading roll 34 as the carriage moves in the downstream direction. Multiple identical carriage sections having a leading and trailing roll can, therefore, be joined together, with every roll being staggered from an adjacent roll.

The carriage 26 can be any suitable apparatus which moves along the top of the purlins and dispenses the support sheet. As seen from FIG. 1, the carriage preferably includes safety handrails 44 and a deck 46 for the worker to stand on while operating or moving the carriage. The rollers 30 are mounted from the deck 46 of the carriage. Preferably, the carriage is equipped with two rollers (front and rear) for each purlin, as shown in FIG. 1. The carriage also includes a framework 48 for mounting the rolls 34 and 42. Mounted on the framework are turning bars 50 which extend laterally across associated support sheets and are positioned slightly above the upper portions 20 of the purlins 18 so as to direct the support sheet to a generally horizontal position.

Attached to the carriage is an optional plate 52 which extends from the carriage in an upstream direction, represented by the arrow 102, which is opposite the downstream direction 28. The plate supports the payed out portion of the support sheet and insulation material so that the support sheet does not drape downwardly, thereby pulling the longitudinal edges of the support sheet off the upper portion of the purlins. If sufficiently built, the plate can be used for fall protection for the workers to prevent them from falling off the leading edge of the previously completed section of roof. The plate can be attached to the carriage by any suitable means. The plate follows the carriage as the carriage moves along the length of the purlins. Preferably, the plate has wheels 54 which also support the plate by rolling along the upper portion 20 of the purlins 18. However, it is not required that the payed out support sheet be supported by the plate. The carriage could be modified so that the support sheet is payed out in such a manner that the support sheet is underneath the plate. If desired, the roll 38 of insulation material 36 could be positioned on the plate 52 above the support sheet. Generally, the plate is located in a gap 56 which exists between the completed section of the roof structure 10 and the carriage 26. The plate hinders wind from blowing vertically through the gap 56 and thus, disturbing the insulation material 36 and the support sheet 32.

The space between the vertical webs 22 of adjacent purlins 18 generally defines an insulation cavity 58, as shown in FIG. 2. The insulation cavity has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

As shown in FIG. 1, a pulling member, such as a winch 60, is attached to the carriage 26 by a mounting bracket 62. The winch includes a spool 64 which can be manually rotated by a handle 66. A tension member, such as a flexible cable 68, is connected to and partially wound around the spool 64. Rotation of the spool causes the cable to be wound around or dispensed out from the spool depending on the direction of rotation of the spool. The cable extends downward from the winch, directed around a turning pulley 70, and then extends along the length of the purlins 18 in the downstream direction 28.

Figure 3:
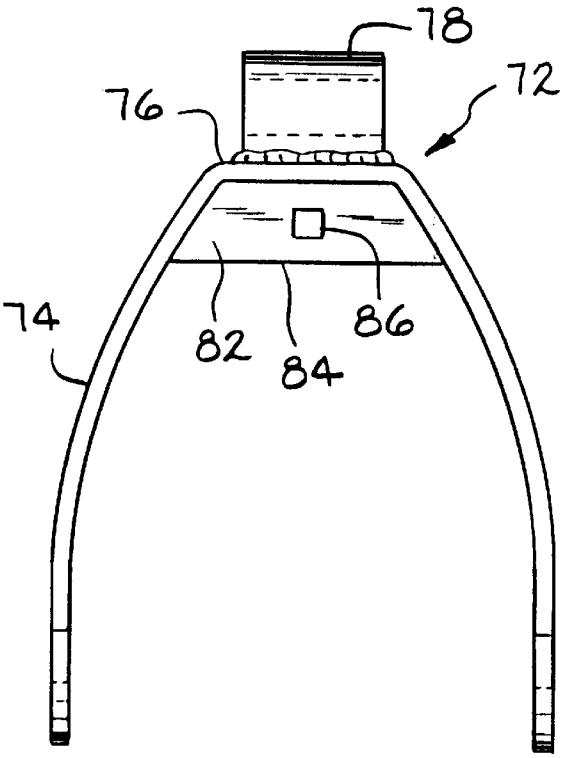
FIG. 3 is a front elevational view of a first embodiment of a grappling member illustrated in FIG. 1, for use in advancing the carriage along the length of plurality of purlins.
Figure 4:
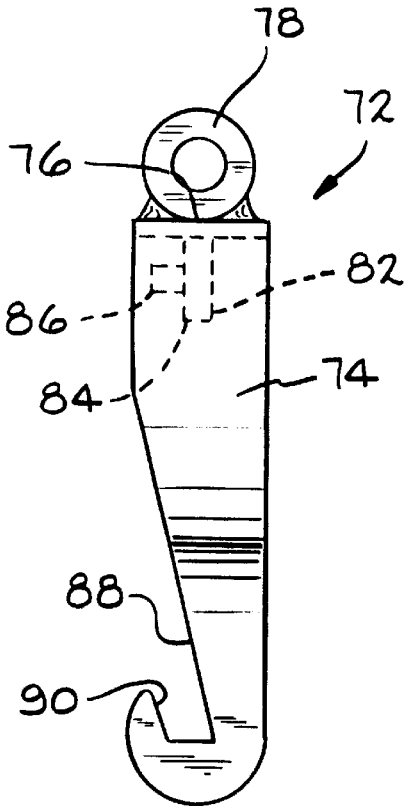
FIG. 4 is a side elevational view of the grappling member of FIG. 3.

The end of the cable is attached to a grappling member, such as a catch 72. As shown in FIGS. 3 and 4, the catch 72 has a generally wishbone shape and includes a pair of arms 74 which extend downwardly from an extension portion 76. A tubular eyelet 78 is attached to the extension portion 76 and receives a loop 80 formed at the end of the cable 68 for attachment therebetween. The extension portion includes a flange 82 having a horizontally extending edge 84. An attachment member, such as a pin 86, extends from the flange 82 of the extension portion facing in a direction towards the carriage, the reason for which will be explained below. Each arm 74 has an angular notch 88 formed therein, defining a hook 90.

The arms 74 of the catch 72 are positioned on opposite sides of the purlin so that the catch straddles the purlin. The horizontal edge 84 is in sliding contact with the upper portion 20 of the purlin. Broadly stated, to move or advance the carriage 26 along the length of the purlins 18 in the downstream direction, the catch 72 is first fixed with respect to the purlins and the rafter beams of the roof structure, and the winch is operated to pull on the cable so that the carriage is advanced with respect to the catch. The catch is fixed with respect to the purlins when the catch is in a locked position, as will be explained in detail below, so that the catch will temporarily not move relative to the purlins. Since the purlins are fastened to the rafter beams, the catch can be fixed with respect to the purlins if the catch is not movable relative to a rafter beam.

Specifically, the winch is first actuated so that the cable is able to be freely unwound from the spool 64. The catch is then moved along the length of one of the purlins 18, such as by means of a push rod 92 (shown in dotted lines in FIG. 1) manually operated by workers standing on the deck 46 of the carriage 26.

Figure 5:
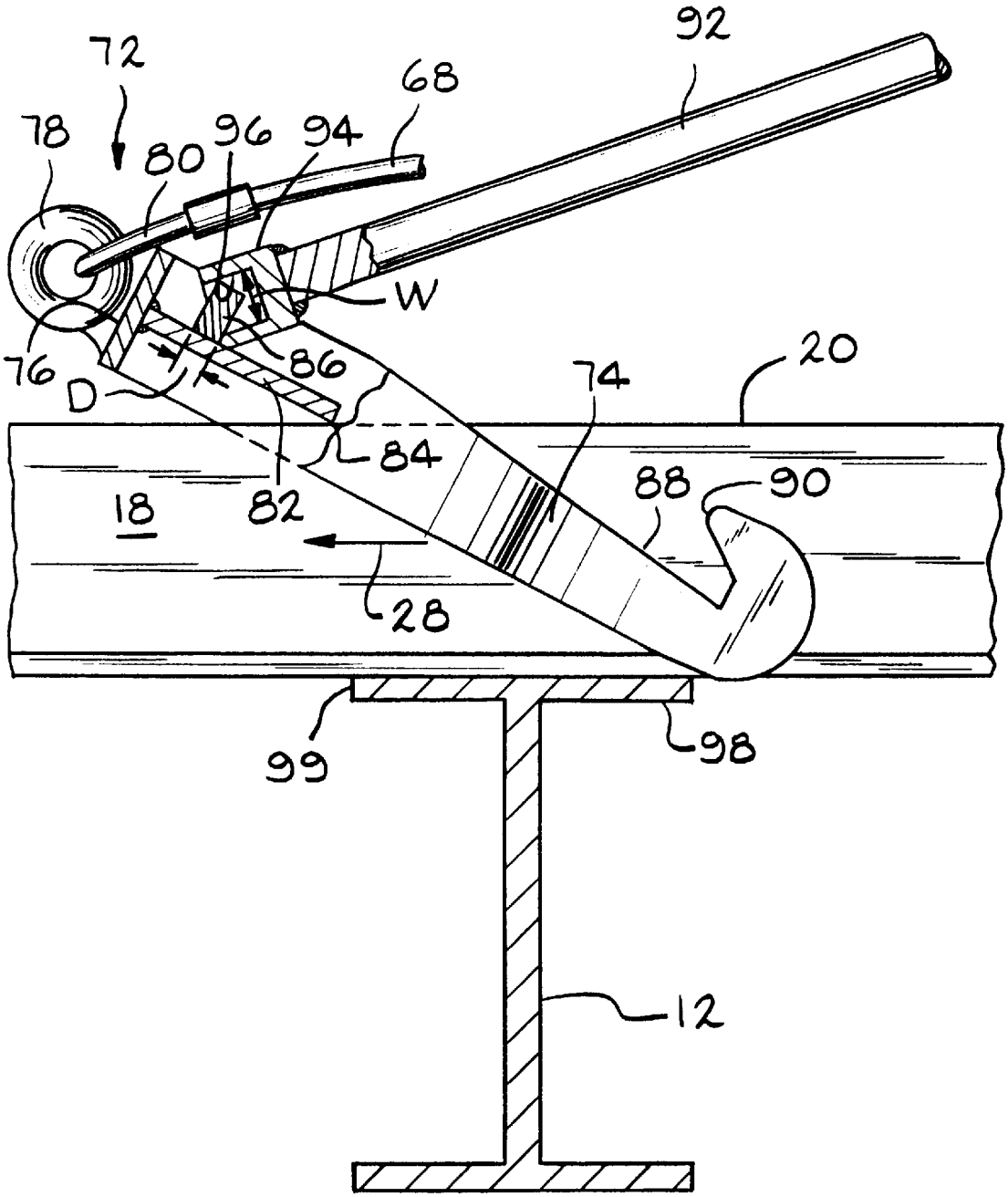
FIG. 5 is a partial sectional view of the grappling member of FIG. 3 illustrating the grappling member being moved into a locked position.

The push rod 92 has an end 94 having a slot 96 formed therein, as shown in FIG. 5. The end of the push rod is positioned so that the pin 86 is disposed in the slot 96. Extending the push rod in the downstream direction 28 pushes the catch 72 in the downstream direction (as shown in FIG. 5). The horizontal edge 84 of the flange 82 of the catch 72 slides along the upper portion 20 of the purlin 18 until the arms of the catch contact an upper flange 98 of one of the rafter beams 12. Further movement of the catch 72 in the downstream direction causes the catch to rotate in a counter clockwise direction, as viewing FIG. 5, about the horizontal edge 84 of the flange 82 of the catch 72. Continued movement of the catch in the downstream direction causes the arms 74 of the catch to slide along the upper flange 20 of the purlin 18 until the end of the arms extend past a downstream end 99 of the upper flange 98 of the rafter beam 12 (the left-hand end of the upper flange 98 when viewing FIG. 5). When the arms have extended past the left-hand end of the upper flange 98, the catch is free to rotate back to a position indicated by phantom lines 100 in FIG. 1, wherein the arms extend generally downward.

Preferably, the slot 96 of the end 94 of the push rod has a width W which is larger than the diameter D of the pin 86 of the catch 72. The slot and the pin enable the push rod to be engaged with the catch so that the end of the catch will not slip off the pin. The slot and the pin also cooperate to enable the catch to rotate about an axis perpendicular to the downstream direction about the edge 84 of the flange 82 of the catch when the catch encounters a rafter beam. Of course, any suitable attachment member assembly can be used with the push rod and the catch.

The winch is then operated to wind the cable on the spool so that the cable is pulled in the upstream direction 102. After any slack has been taken up in the cable, the catch will be moved in the upstream direction 102. When the catch has been pulled a sufficient distance, the catch will be moved into a locked position, wherein the hooks 90 of the arms 74 engage the upper flange 98 of the rafter beam 12, as shown in solid lines in FIG. 1. After the catch is in the locked position, any further pulling movement of the cable by the winch causes the carriage to be pulled towards the catch. Thus, the carriage is advanced along the length of the purlins. The carriage can then be advanced a sufficient distance so the next sheet of hard roofing material 40 can be fastened to the upper portions of the purlins. Once the carriage has been moved next to the catch, the winch is then actuated so that the cable is able to be freely unwound from the spool, and the catch is pushed along the purlins by the push rod until the catch engages the next rafter beam, in the manner as described above. The carriage and the catch can be systematically moved along the entire length of the roof structure.

Preferably, the winch has a ratchet assembly (not shown) which selectively prevents rotation of the spool in the direction which dispenses the cable from the spool. Thus, tension can be kept on the cable so that the support sheet 32 has longitudinal tension as the support sheet is being dispensed from the rolls 34 or 42. It is typically desirable to have longitudinal tension on the support sheet so that the support sheet supports the weight of the insulation material prior to the fastening of the hard roofing material to the purlins.

Figure 6:
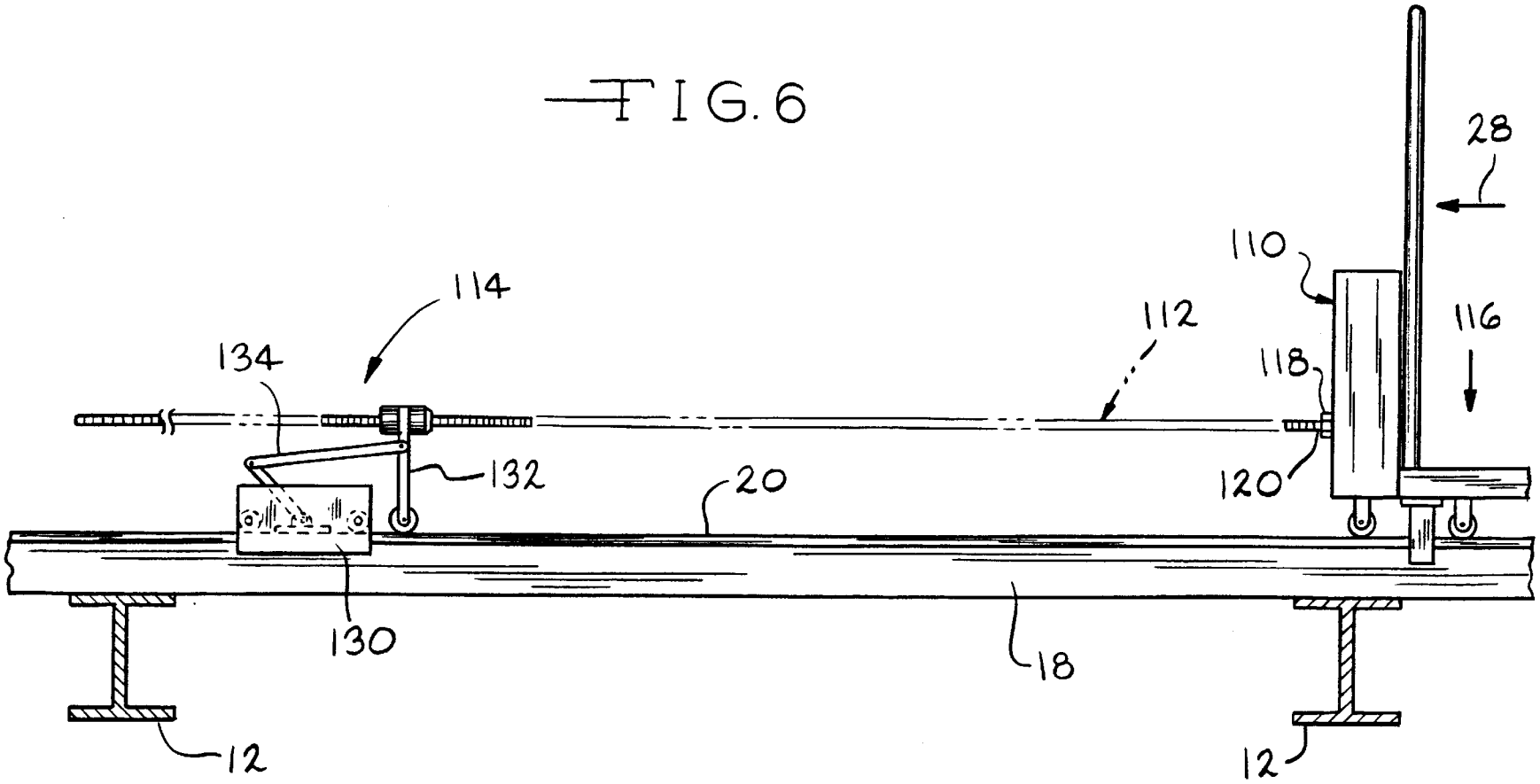
FIG. 6 is a schematic side view of the carriage and a second embodiment of a grappling member and a pulling device for advancing the carriage along the length of the purlins, in accordance with the present invention.

Referring now to FIG. 6, there is illustrated a second embodiment of a pulling device, such as a motor assembly 110, a second embodiment of a pulling member, such as an elongated threaded rod 112, and a second embodiment of a grappling member, such as clamp 114. The motor assembly is attached to a carriage 116, shown partially broken away, which is similar in function and structure to the carriage 26 of FIG. 1. As will be explained in detail below, the motor assembly 110, the threaded rod 112, and the clamp 114 cooperate to advance the carriage 116 along the length of the purlins 18 in the downstream direction 28.

The motor assembly 110 includes a conventional motor drive assembly (not shown) which rotates an output shaft 118. Preferably, the motor drive assembly is powered by a generator (not shown) which is placed on the carriage 116. The output shaft 118 is rotationally fixed to an end 120 of the threaded rod 112 and imparts rotational movement thereon when the motor assembly is actuated to rotate the output shaft 118. The threaded rod has external threads 122 formed thereon which preferably extend the entire length of the threaded rod. The threaded rod extends in a direction generally parallel to the purlins.

Figure 7:
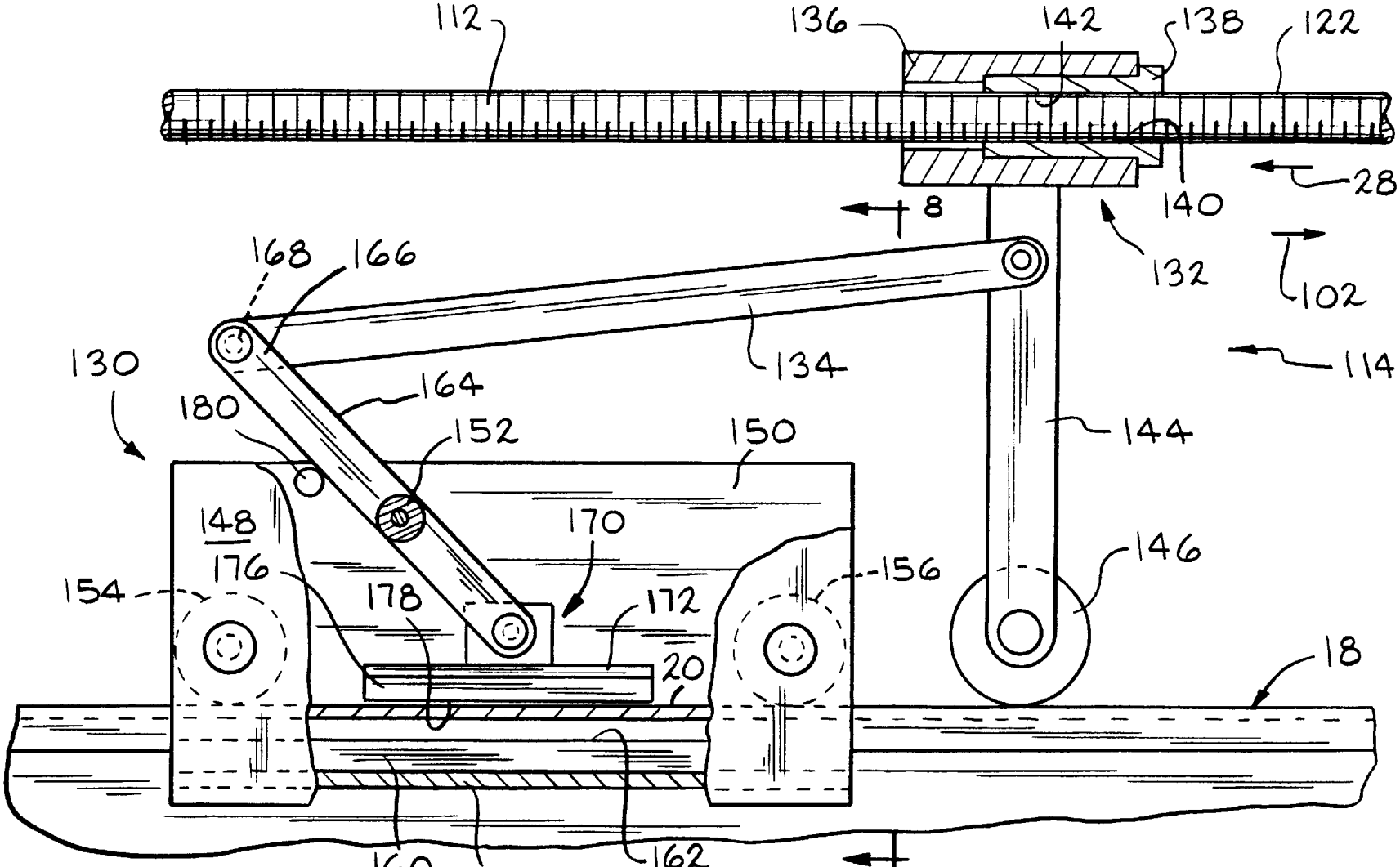
FIG. 7 is an enlarged sectional side view of the grappling member of FIG. 6, shown in the unlocked position.
Figure 8:
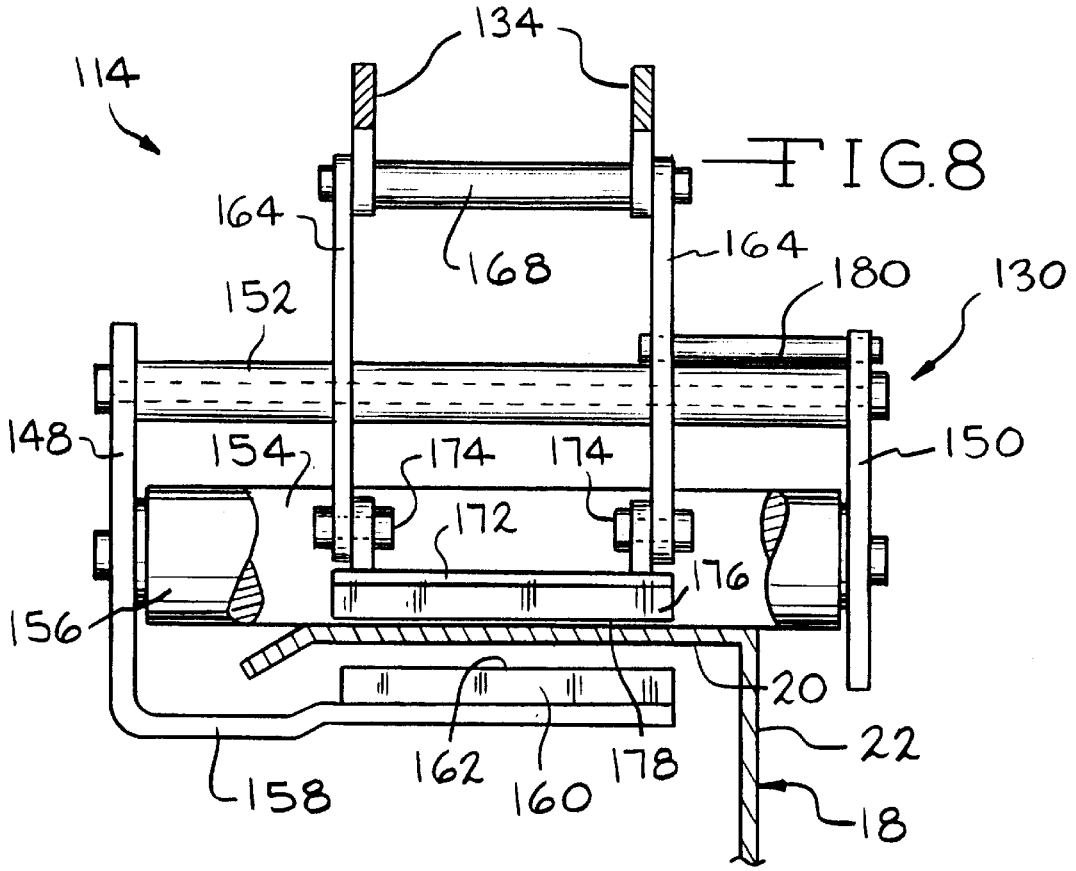
FIG. 8 is a sectional view of the grappling member taken along Line 8—8 of FIG. 7, illustrating the grappling member engaged with a Z-shaped purlin.

The clamp, as best shown in FIGS. 7 and 8, generally includes a main body 130 and a support assembly 132, connected by a first pair of linkage arms 134. The support assembly 132 includes a tubular housing 136 having a threaded insert 138 disposed therein. The threaded insert is rotatably fixed with respect to the tubular housing. The threaded insert has a bore 140 having internal threads 142 formed in the surface of the wall of the bore. The internal threads threadably engage the external threads 122 of the threaded rod 112. Attached to the tubular housing 136 is a vertically extending leg 144 having a roller 146 rotatably mounted on the end thereof. The leg 144 can be a single structure or a pair of legs attached to the tubular housing. The roller 146 rolls along the upper portion 20 of the purlin 18 as the clamp 114 moves along the length of the purlin.

The main body 130 of the clamp 114 includes first and second side walls 148 and 150. Extending between the side walls is a pivot rod 152 and second and third rollers 154 and 156. The second and third rollers selectively roll along the upper portion 20 of the purlin 18 when the clamp 114 is placed in a locked position, as will be explained in detail below. Extending horizontally from the side wall 148 is a horizontally extending plate 158 positioned underneath the upper portion 20 of the purlin 18. Attached to the plate 158 is a stationary contact member or pad 160. The pad 160 has a surface 162 facing the lower surface of the upper portion 20 of the purlin 18. Pivoting about the pivot rod 152 is a second pair of linkage arms 164. Each linkage arm 164 has an end 166 which is pivotally connected to the ends of the first pair of linkage arms 134 by a pivot pin 168. The other ends of the second pair of linkage arms 164 are pivotally connected to a movable contact member, indicated generally at 170. The movable contact member 170 has a plate 172 and a pair of flanges extending therefrom which are pivotally connected to the second pair of linkage arms 164 by a pair of pins 174. Attached to the plate 172 is a pad 176 having a surface 178 facing the upper surface of the upper portion 20 of the purlin 18.

Broadly stated, to move or advance the carriage 116 along the length of the purlins 18 in the downstream direction 28, the clamp 114 is first fixed with respect to the purlins, and the motor assembly 110 is actuated to rotate the threaded rod 112 so that the carriage 116 is advanced with respect to the clamp 114. Specifically, the motor assembly is actuated to rotate the output shaft 118. Since the output shaft is attached to the threaded rod 112, the threaded is rotated in the same direction. Rotation of the threaded rod causes the internal threads 142 of the threaded insert 140 to engage the external threads 122 of the threaded rod 112 so that an axial force is imparted on the threaded insert. Since the threaded insert is rotationally fixed with respect to the support assembly 132, the threaded insert and the support assembly is advanced axially along the length of the threaded rod. Depending on the rotation of the threaded rod, the threaded insert will be urged either the downstream direction 28 or the upstream direction 102. Thus, to initiate the advancement of the clamp in the downstream direction 28, the threaded rod is rotated in a rotational direction so as to urge the threaded insert in the downstream direction 28.

As the support member 132 is pushed in the downstream direction, a force is imparted on the first pair of linkage arms 134 which causes a counter-clockwise rotation of the second pair of linkage arms 164, as viewing FIG. 7, about the pivot rod 152. The rotation of the second pair of linkage arms 164 will raise the movable contact member 170 upward, thereby disengaging the contact between the surface 178 of the pad 176 and the upper portion 20 of the purlin 18. Note that in the position of the clamp 114 illustrated in FIG. 7, there is no contact between the pad 162 and the upper portion 20 of the purlin 18. The second pair of linkage arms 164 will rotate in the counter-clockwise direction until a stop 180 extending from the side wall 150 is encountered. Further movement in the downstream direction of the first pair of linkage arms 134 causes the main body 130 to roll along the upper portion of the purlin in the downstream direction 28 via the rollers 154 and 156. Thus, movement of the support assembly 132 in the downstream direction causes the pads 160 and 176 to disengage from the purlin, and the clamp rolls along the purlin by means of the rollers 146, 154, and 156.

Figure 9:
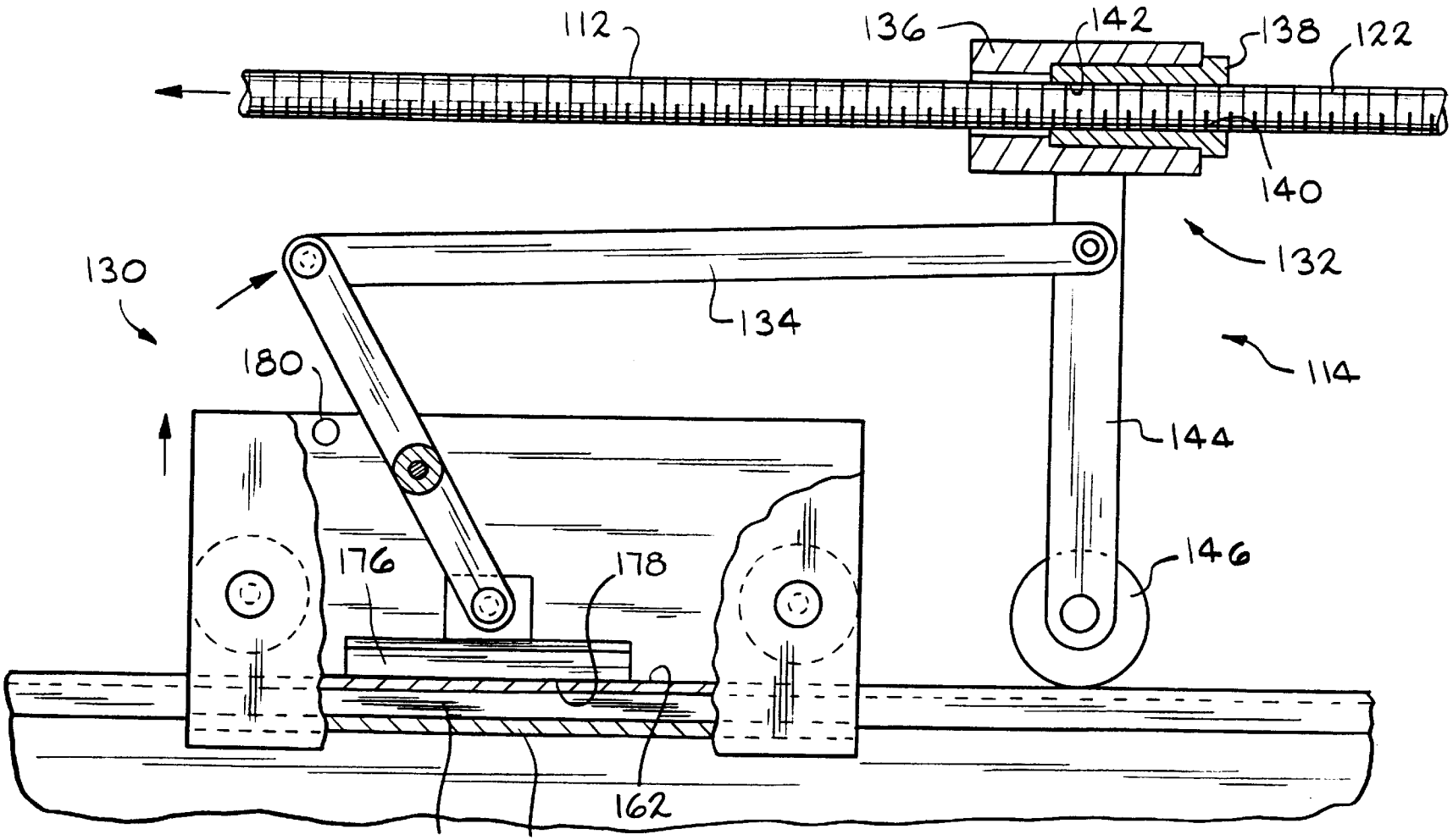
FIG. 9 is an enlarged sectional side view of the grappling member of FIG. 6, shown in the locked position.

When the clamp 114 has moved out from the carriage in the downstream direction a desired distance, the clamp is then placed into a locked position, as illustrated in FIG. 9, so that the clamp is fixed with respect to the purlin 18. To place the clamp in the locked position, the motor assembly 110 rotates the output member 118 and consequently the threaded rod 112 in the opposite rotational direction as described above so that the threaded insert 138 and the support member 132 are pulled or urged in the upstream direction 102. As the support assembly 132 is pulled in the upstream direction, the first pair of linkage arms 134 pulls on the second pair of linkage arms 164 causing a clockwise rotation thereof about the pivot rod 152, as viewing FIG. 9. The rotation of the second pair of linkage arms 164 will lower the movable contact member 170 downward, thereby engaging the contact between the surface 178 of the pad 176 and the upper portion 20 of the purlin 18. Thus, the surface 178 of the pad 176 is frictionally engaged with upper surface of the upper portion 20 of the purlin 18. Due to the frictional engagement between the pad 176 and the purlin 18, further rotation of the second pair of linkage arms 164 in the clockwise direction will lift the main body 130 upward so that the rollers 154 and 156 no longer are in contact with the upper portion of the purlin. The main body 130 will continue to move upward until the surface 162 of the pad 160 contacts the lower surface of the upper portion 20 of the purlin 18, thereby placing the clamp 114 in the locked position, as illustrated in FIG. 9. At the locked position, the upper portion of the purlin is pinched between pads 160 and 176, thereby fixing the clamp 114 with respect to the purlin. Further movement of the support assembly 132 in the upstream direction causes the carriage to be pulled in the downstream direction 28 towards the clamp 114. Thus, the carriage is advanced along the length of the purlins. Once the carriage has been moved a desired distance to enable the next sheet of hard roofing material to be fastened to the purlins, the threaded rod 112 can be rotated in the opposite direction to advance the clamp along the purlin in the downstream direction, thereby repeating the procedure as described above.

If desired, the pads 160 and 176 can be made of a material having a high coefficient of friction, such as rubber, so that the pads 160 and 176 have high frictional engagement with the respective surfaces of the upper portion of the purlin. Alternatively, the surfaces 162 and 178 can be textured, such as grooved, to provide high frictional engagement with the purlin.

The threaded rod 112 can be any suitable length which corresponds to the desired incremental distance the carriage is to be moved. For example, the length of the threaded rod can correspond to the width of the sheets of hard roofing material 40 or any multiples thereof, so that the carriage is moved incrementally with respect to the fastening of the sheets of hard roofing material.

A logic circuit (not shown) may be incorporated into the controls of the motor so that the motor is operated for a predetermined amount of time. Thus, a worker can depress a single switch which operates the motor to rotate the threaded rod for a predetermined amount of time corresponding to a selected distance of movement of the carriage. The logic circuit would enable the carriage to be moved, for example, the width of the sheets of the hard roofing material 40.

Figure 10:
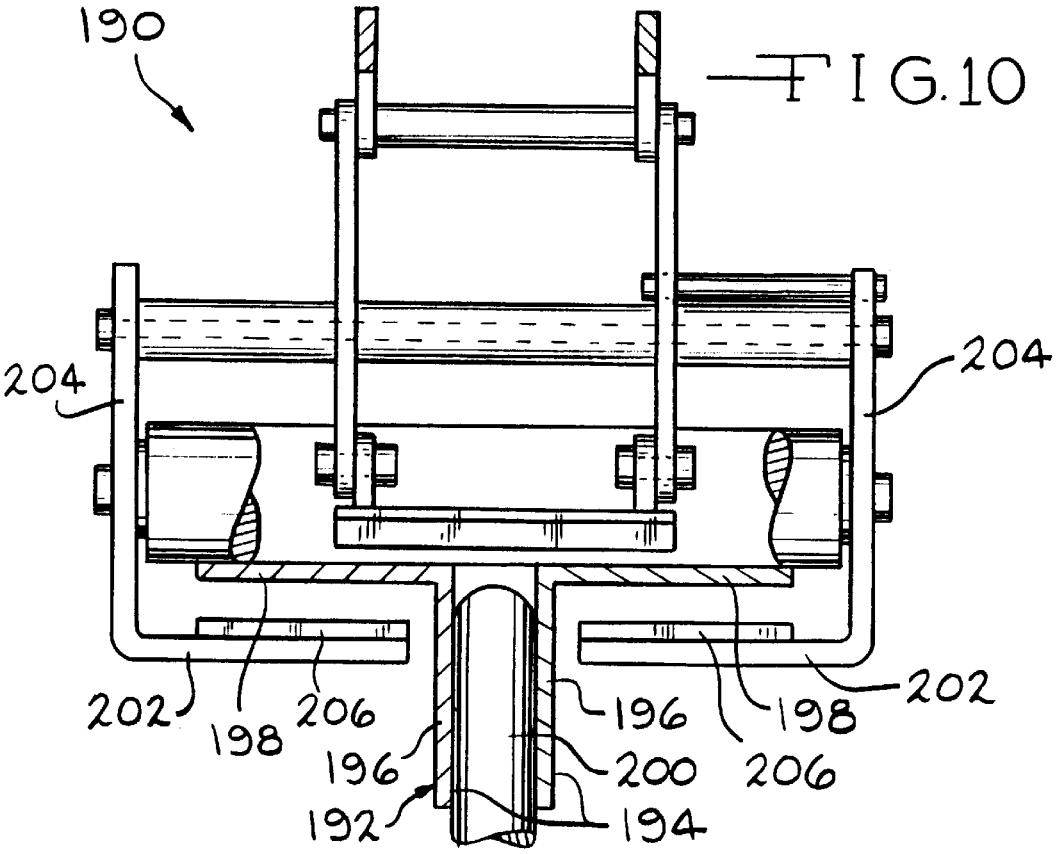
FIG. 10 is a sectional view of a third embodiment of a grappling member, illustrating the grappling member engaged with an bar joist, in accordance with the present invention.

Referring now to FIG. 10, there is illustrated a third embodiment of a grappling member, a clamp 190. The clamp 190 is similar in structure and function to the clamp 130 illustrated in FIGS. 6 through 9. The main difference between the clamp 114 and the clamp 190 is that the clamp 190 is designed to operate with purlins having an I shaped cross-section, such as a conventional bar joist 192. The bar joist 192 includes a pair of beams 194, such as conventional angle iron beams, having an L-shaped cross-section. The L-shaped beams are positioned so that vertically extending portions 196 face each other, and horizontally extending portions 198 extend away from one another. Vertically extending bars 200 are positioned between and welded to the vertical portions 196 of the beams 194. The bars can be angled with respect to the length of the beams 194 so that the bars form a zigzagged cross pattern when viewing the bar joist 192 from the side. The lower portion of the bar joist 192 is similarly formed from a pair of L-shaped beams (not shown), so that the bar joist has a generally I-shaped cross-section.

The clamp 190 includes a pair of plates 202 which extend horizontally toward one another from a pair of side walls 204. Attached to each plate is a contact member, such as pads 206. The pads 206 perform the same function as the pad 160 of the clamp 130, in that the pads 206 frictionally engage the lower surfaces of the horizontal portions 198 of the beams 194 when the clamp 190 is placed into a locked position.

Although the winch 60, the cable 68, and the catch 72 were described in cooperation with each other, as well as the motor assembly 110, the threaded rod 112, and the clamp 114 were described in cooperation with each other, it should be understood that any suitable combination of pulling device, tension member, and grappling member can be used. For example, the winch 60 and the cable 68 can be used in cooperation with clamp 114.

Figure 11:
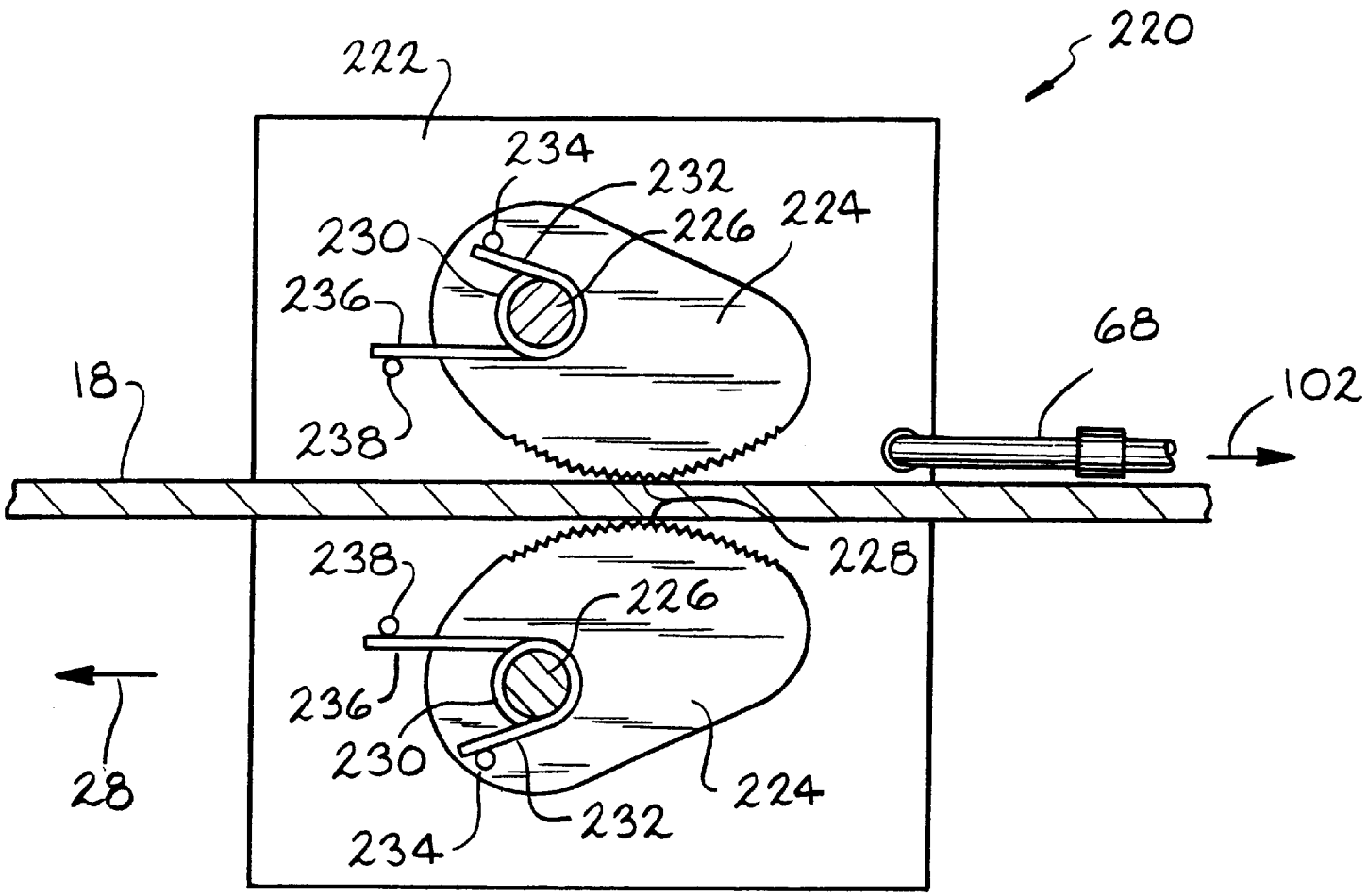
FIG. 11 is a schematic sectional view of a fourth embodiment of a grappling member, in accordance with the present invention.

Referring now to FIG. 11, there is shown a fourth embodiment of a grappling member, such as a clamp 220 for clamping on the purlin when it is desired to advance the carriage along the length of the purlins in the downstream direction. The clamp 220 is also adapted to be mounted for movement the purlin. The clamp 220 includes a housing 222. A pair of cams 224 are pivotally mounted on the housing by a pair of pivot pins 226, respectively. Each cam includes a curved edge 228 which contacts any suitable portion of the purlin 18, such as the upper portion 20 or the vertical web 22. Preferably, the curved edges 228 have a roughed surface, such as teeth formed therein, to provide a high coefficient of friction between the cam and the purlin. Preferably, the cams are rotatably biased by coil springs 230 in a direction to engage the curved edges 228 against the respective surfaces of the purlin. The springs 230 have a tang 232 which acts against stops 234 formed on the respective cam. The springs also have a tang 236 which acts against stops 238 formed on the housing 222. A tension member, such as the cable 68, is attached to the housing 222 for operatively connecting the clamp 220 to the carriage.

To move or advance the clamp 220 in the downstream direction 28, the clamp 220 is simply pushed in the downstream direction, such as by a push rod. As the clamp moves in the downstream direction 28, the cams 224 are positioned and pivoted such that the curved edges 228 of the cams 224 slide along the surface of the purlin. To place the clamp 220 in a locked position, the cable 68 is pulled in the upstream direction 102 by a suitable pulling device, such as a winch. When the cable is pulled, the frictional contact between the curved edge 228 and the surface of the purlin 18 biases the cams in a rotational direction so that the curved edges are directed or forced towards the surface of the purlin in a wedge-like manner. Thus, the purlin is pinched between the cams and the frictional contact therebetween places the clamp in a locked position relative to the purlin. The carriage can then be advanced in the downstream direction by pulling on the cable.

The principle and mode of operation of this invention have been described in its preferred embodiments. However, it should be noted that this invention may be practiced otherwise than as specifically illustrated and described without departing from its scope.

What is claimed is:

1. An apparatus for providing a roof structure of the type having a plurality of purlins spaced apart from one another in a parallel arrangement, the apparatus comprising:

a carriage mounted for movement along the length of the plurality of purlins;

a grappling member mounted for movement along the length of a first one of the plurality of purlins, the grappling member adapted to be temporarily placed into a locked position so that the grappling member is fixed with respect to the first purlin;

a tension member operatively connecting the grappling member to the carriage; and a pulling device for pulling the tension member to shorten the distance between the grappling member and the carriage, thereby advancing the carriage along the length of the purlins in a direction towards the grappling member when the grappling member is in the locked position.

2. The apparatus of claim 1, wherein the pulling member is attached to the carriage.

3. The apparatus of claim 1, wherein the carriage supports a roll of a support sheet, the support sheet being dispensed as the carriage travels along the length of the purlins so that the support sheet depends from adjacent purlins.

4. The apparatus of claim 1, wherein the tension member is a cable.

5. The apparatus of claim 4, wherein the grappling member has an eyelet for receiving an end of the cable to attach the cable to the grappling member.

6. The apparatus of claim 1, wherein the pulling member is an elongated rod.

7. The apparatus of claim 6, wherein the elongated rod has external threads formed thereon, and wherein the grappling member has a threaded member having internal threads formed therein which threadably engage the external threads of the elongated rod.

8. The apparatus of claim 7, wherein the pulling member has a motor rotatably engaged with the elongated rod, the threaded member being rotationally fixed to the grappling member, the operation of the motor causing rotation of the elongated rod which advances the position of the threaded member with respect to the threaded rod.

9. The apparatus of claim 1, wherein the plurality of purlins are supported by rafter beams spaced apart from one another in a parallel arrangement and extending in a direction perpendicular to the purlins, the grappling member includes a hook, and the hook is adapted to engage a first one of the plurality of rafter beams for placing the grappling member in the locked position so that the grappling member is fixed with respect to the first purlin.

10. The apparatus of claim 9, wherein the grappling member has a pair of opposing arms, each arm having a hook adapted to engage the first rafter beam.

11. The apparatus of claim 9, wherein the grappling member has an attachment member for receiving an end of a push rod for advancing the grappling member along the length of the first purlin, the attachment member and the end of the push rod being engaged so that the grappling member can be partially rotated about an axis perpendicular to the first direction while maintaining engagement therebetween during advancement of the grappling member along the length first purlin.

12. The apparatus of claim 1, wherein the grappling member includes first and second contact members which are movable with respect to one another to respective positions to place the grappling member in the locked position.

13. The apparatus of claim 12, wherein the grappling member further includes a body and a linkage arm pivotally mounted on the body, the first contact member being attached to the linkage member such that rotation of the linkage arm in a first rotational direction causes the first contact member to engage the first purlin, and wherein the linkage member is operatively attached to the tension member and biased in the first rotational direction when the tension member is being pulled by the pulling member.

14. The apparatus of claim 13, wherein the second contact member is fixably attached to the body of the grappling member.

15. The apparatus of claim 12, wherein the tension member is an elongated rod having external threads formed thereon, the grappling member including a threaded member having internal threads formed therein which threadably engage the external threads of the elongated rod.

16. The apparatus of claim 1, wherein the grappling member includes a pair of cams pivotally mounted on the grappling member, each cam having a curved edge, the cams being positioned on the grappling member such that as the grappling member is pulled in a second direction opposite the first direction by the tension member, the cams are rotated to place the grappling member in the locked position.

17. The apparatus of claim 16, wherein the grappling member includes a pair of springs for biasing the respective pair of cams in a rotational direction towards engagement with the portion of the first purlin.

18. The apparatus of claim 1, wherein the tension member is a cable, the pulling member having a winch adapted to wind the cable when the winch is operated to shorten the distance between the grappling member and the carriage.

19. A method of advancing a carriage along a roof structure of the type having a plurality of purlins spaced apart from one another in a parallel arrangement, the method comprising the steps of:

a. providing a carriage mounted for movement along the length of the plurality of purlins;

b. providing a grappling member mounted for movement along the length of a first one of the purlins;

c. providing a pulling device for pulling a tension member operatively connected to the grappling member;

d. advancing the grappling member along the length of the first purlin in a first direction away from the carriage;

e. fixing the position of the grappling member relative to the first purlin; and f. operating the pulling device so that the pulling device pulls on the tension member, thereby advancing the carriage along the length of the purlins in the first direction towards the grappling member.

20. The method of claim 19, wherein the carriage supports a roll of support sheet, and further including dispensing as the carriage travels along the length of the purlins so that the support sheet depends from adjacent purlins.

21. The method of claim 19, wherein the grappling member is advanced along the length of the first purlin by manually pushing the grappling member by means of a push rod.

22. The method of claim 19, wherein the plurality of purlins are supported by rafter beams spaced apart from one another in a parallel arrangement and extending in a direction perpendicular to the purlins, the grappling member includes a hook, the position of the grappling member is fixed with respect to the first purlin by engaging the hook of the grappling member to a first one of the plurality of rafter beams.

23. The method of claim 19, wherein the tension member is an elongated rod having external threads formed thereon, the external threads engaging internal threads formed in a threaded member rotationally fixed to the grappling member, and wherein the grappling member is advanced along the first purlin by rotating the elongated rod in a first rotational direction, and the carriage is advanced by rotating the elongated rod in a second rotational direction opposite the first rotational direction.

24. The method of claim 23, wherein the pulling member includes a motor for rotation of the elongated rod, and further operating the motor for a predetermined amount of time to advance the carriage a predetermined distance.

25. The method of claim 24, wherein the pulling member includes a logic circuit which is actuated by a single switch such that upon actuation of the switch, the logic circuit operates the motor for a predetermined amount of time.

26. The method of claim 19, wherein the grappling member includes a pair of cams pivotally mounted on the grappling member and positioned on opposite sides of a portion of the first purlin, each cam having a curved edge which frictionally engages the respective portion of the first purlin, the position of the grappling member is fixed with respect to the first purlin by pulling on the grappling member is a second direction opposite the first direction by the tension member so that the cams are rotated to frictionally engage the portion of the first purlin so as to pinch the portion of the first purlin.

27. The method of claim 19, wherein the tension member is a cable and the pulling member is a winch, the pulling device being operated by operating the winch to wind the cable, thereby advancing the carriage along the length of the purlins in the first direction.

* * * * *